United States Patent [19]

Esper et al.

[11] 4,418,661

[45] Dec. 6, 1983

[54] GLOW PLUG, PARTICULARLY FOR DIESEL ENGINE

[75] Inventors: Friedrich Esper, Leonberg; Thomas Frey, Rutesheim; Heinz Geier, Gerlingen; Gerhard Holfelder, Ditzingen; Günther Knoll, Stuttgart, all of Fed. Rep. of Germany

[73] Assignee: Robert Bosch GmbH, Stuttgart, Fed. Rep. of Germany

[21] Appl. No.: 267,516

[22] Filed: May 27, 1981

[30] Foreign Application Priority Data

Feb. 7, 1981 [DE] Fed. Rep. of Germany ..... 3104401

[51] Int. Cl.[3] ..... F23G 7/00; F02P 19/02

[52] U.S. Cl. ..... 123/145 A; 123/145 R; 361/264

[58] Field of Search ..... 123/145 A, 145 R; 361/206; 317/94, 98; 313/137, 144

[56] References Cited

U.S. PATENT DOCUMENTS

| | | | |
|---|---|---|---|
| 2,030,937 | 2/1936 | Reichmann | 123/145 A |
| 3,749,980 | 7/1973 | Baxter | 123/145 A |
| 4,200,077 | 4/1980 | Kanhl et al. | 123/145 A |
| 4,237,843 | 12/1980 | Page et al. | 123/145 A |

FOREIGN PATENT DOCUMENTS

| | | | |
|---|---|---|---|
| 1208074 | 2/1960 | France | 123/145 A |
| 86805 | 1/1956 | Norway | 123/145 A |

*Primary Examiner*—Raymond A. Nelli

*Attorney, Agent, or Firm*—Frishauf, Holtz, Goodman & Woodward

[57] ABSTRACT

To decrease the preheat time and power requirements in preheater-type glow plugs for Diesel engines, a closed ceramic tube (20), for example of aluminum oxide and of about 5 mm diameter has, on the bottom (21) thereof applied a layer or film-like heater element (24, 24'), for example in an undulating or zig-zag configuration (FIG. 2) or in form of a constriction or pinch (FIG. 4: 24') to provide a concentrated point or strip source of heat. The heater layer itself is protected by a protective coating (25) and, to provide for the required heat distribution, the underlying bottom (21, 21') of the tube (20, 20') supports an insulating intermediate layer and possibly a heat conductive layer is intermediate. Preheat times in the order of 1–2 seconds, with lower current consumption than prior wound-wire plugs can be obtained.

23 Claims, 4 Drawing Figures

GLOW PLUG, PARTICULARLY FOR DIESEL ENGINE

The present invention relates to glow plugs to preheat gases, particularly to preheat combustion gases used in internal combustion engines, and especially to glow plugs for use in Diesel engines.

BACKGROUND

Various types of glow plugs are known and used; one such plug described in British Pat. No. 225,186 (to which German Pat. No. 406,932 corresponds), assigned to the assignee of this application, has an insulating body, for example a ceramic, about which a spiral heating wire is wound, the ceramic body protecting a central connecting bolt against attack by combustion gases. This type of glow plug has a high heat capacity and, due to the construction, requires a comparatively long preheating time. Thus, the time required for gas-fuel mixtures to reach the required ignition temperature is comparatively long. Construction of a glow plug of this type is comparatively difficult, so that the final price thereof is comparatively high.

It has also previously been proposed—see German Patent Disclosure Document No. 29 00 984, Sperner et al.—to utilize a tubular ceramic carrier for a heating spiral of a glow plug, in which the spiral can be in form of a wire, ribbon, or a layer applied to a carrier tube which is made of ceramic, quartz glass, glass ceramic, or high silicate glass. This type of glow plug, also, requires comparatively long preheat time.

THE INVENTION

It is an object to provide a glow plug, particularly for use in Diesel engines, which has a very short preheat time, excellent life, and permits manufacture by easily employed methods and systems, so that the cost of the glow plug can be low.

Briefly, a ceramic tube with a closed bottom has a layer or film of heater material located on the tube essentially only in the region of the closed bottom, the hollow interior of the tube being preferably left empty.

The heater layer, applied only to the closed bottom, can be a film layer made, for example, of a platinum-rhodium alloy, which may, additionally, be mixed with a ceramic material, for example aluminum oxide; other metals, such as platinum metals, alloys of platinum metals, or other suitable electrically conductive materials such as, for example, silver Perowskite, may be used. The heater layer can be integral with connecting strips, likewise formed as layers, and positioned at the surface of the ceramic tube. Preferably, the heater layer is positioned at the outer surface of the ceramic tube, and is additionally covered by a protective layer.

The glow plug has the advantage that the preglow temperature can be reached in extremely short time, in automotive applications in the order of two seconds, for example, and has excellent long-life characteristics.

Particularly short preglow time periods are obtained if the heater element is formed as a constricted region between connecting tracks. To provide for thermal insulation and tolerable thermal gradients with respect to the ceramic carrier tube or, more precisely, with respect to the closed bottom portion thereof, a porous ceramic intermediate layer is preferably positioned between the heater element and the closed bottom of the ceramic tube. An additional heat conductive layer may also be used, and is desirable in many applications.

The glow plug can easily be associated with an opto-electronic combustion sensor. Such a combustion sensor—known per se—is desirable in various applications to obtain an output signal representative of the instant of initiation of ignition and, additionally, to monitor the continued course of ignition of the fuel-air mixture within an internal combustion engine. Such a combustion sensor can be formed as a light guide element which is carried through a central opening in the connecting bolt for the electrical connection of the heater layer of the glow plug. The arrangement provides for reliable positioning of such an optical sensing element, insuring long trouble-free operation therein.

DRAWINGS

Figure 1:
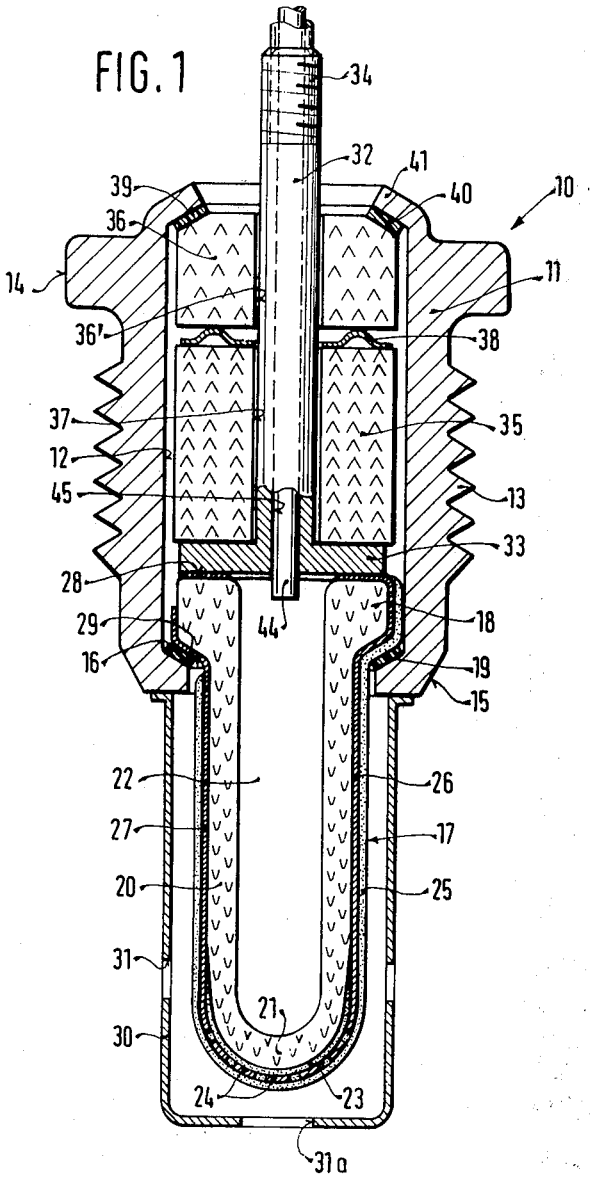
FIG. 1 is a schematic longitudinal sectional view through a glow plug to a scale which is enlarged with respect to that of an actual plug.

The glow plug 10 (FIGS. 1, 2) has a tubular metal housing 11, in plug form, with a central longitudinal bore 12. The outer surface of plug 10 is formed with a screw-in thread 13 and a hexagonal nut head 14 for engagement with a socket wrench or the like. A sealing seat 15 is provided at the combustion-end side of the socket 11. The longitudinal bore 12, at the side facing the combustion chamber, is formed with an internal shoulder 16 on which the glow plug body 17 is seated. Glow plug body 17 has an externally expanding flange 18. A copper contact ring 19 is interposed between the shoulder 16 of the plug housing or socket 11 and the glow plug body 17. The copper contact ring 19 simultaneously forms a seal as well as an electrical contact element or terminal.

The glow plug body 17 has a ceramic carrier tube 20. The end thereof facing the combustion chamber is closed to form a closed bottom 21. The glow plug body 17 extends from the metal housing 11. The ceramic tube 20 is made of electrically insulating ceramic material or a glass ceramic. A preferred material is aluminum oxide.

In one example, the outer diameter of the tube 20 extending from the housing 11 is about 5 mm; for such a tube, a suitable wall thickness of the bottom 21 is about b 0.5 mm, which may vary, however, depending on use of the glow plug 10 between 0.3 mm and about 1.0 mm. The wall thickness of the ceramic tube 20 preferably is constant up to the flange 18 in order to obtain a low heat capacity for the glow plug body 17. The hollow interior space 22 within the ceramic tube is preferably left empty, also in order to decrease the heat capacity of the glow plug body 17. The bottom 21 can be generally cup-shaped, for example with essentially semi-spherical shape smoothly merging into the tube; other shapes, however, are also possible. The bottom 21 of the ceramic tube is covered at its outside with a thin, porous, electrically insulating intermediate layer 23, preferably made of aluminum oxide, and provided to accept thermal expansion and to prevent too rapid heat transfer from the heater element 24 to the ceramic tube 20. The intermediate layer 23 can be extended on the ceramic tube 20 in the direction of the flange 18 thereof. It is primarily needed, however, within the region of application of the heater element 24, that is, at the region or zone of the closed bottom 21 of the tube 20.

Figure 2:
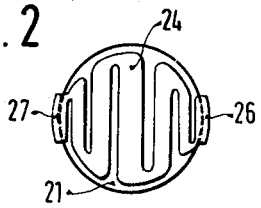
FIG. 2 is a bottom view of the outside of the end face of the ceramic tube, with a protective layer removed—or being transparent.

The heater element 24 is essentially limited to the area of the closed bottom 21 of the ceramic tube 20. It is formed as a film or layer, and is made of a platinum-rhodium alloy which is mixed with ceramic material, for example aluminum oxide. Other platinum metals, alloys of platinum metals, or other suitable electrically conductive materials, such as for example silver Perowskite, may be used instead of platinum-rhodium alloys for the heater element 24. The heater element 24—as best seen in FIG. 2—is applied in undulating or zig-zag configuration. This results in high energy density. The heater element 24 is placed on the bottom 21 of the ceramic tube 20 over a surface region which is less than the covering surface of the intermediate layer 23.

An electrically insulating dense protective layer 25 of ceramic material, for example aluminum oxide, covers the heater element 24, and protects the heater element against abrasion, corrosion, and short circuit.

Two electrically conductive tracks 26, 27 are connected to the heater element at the two ends thereof. The conductive tracks may consist of a mixture of platinum and aluminum oxide, but other platinum metals or alloys of platinum metals, or other suitable electrically conductive substances, such as silver Perowskite, and a ceramic material, may be used. The material of the heater element 24 and of the conductive tracks may be the same. The conductive tracks 26, 27, for the foregoing example of a 5 mm diameter tube, have a width of about 2 mm. The first conductive track 26 extends up to the facing surface 28 of the ceramic flange 18. The second conductive track 27 terminates behind the region 29 of the flange facing the combustion chamber side of the plug. The protective layer 25 covers the first conductive track 26 in its entirety, except the contacting region at the facing side 28 of the ceramic tube; it also covers the second conductive track 27, terminating however short of the combustion chamber side 29 of the flange, to leave the track 27 free in the region of the contact ring 19, so that electrical contact to the metal socket element 11 can be effected from track 27 through the contact ring 19. The intermediate layer 23 as well as the protective layer 25 have a thickness which is preferably about 0.02 mm, but which may vary between 0.01 and 0.05 mm.

The portion of the glow plug 17 which extends from the housing 11 is protected by a protective shield 30 which extends therearound, with clearance. Protective shield 30 has openings 31 for access of fuel vapor-air mixture therethrough. Preferably, it is made of heat-resistant sheet metal and secured to the terminal portion of the metal housing 11 in any suitable and known manner, for example by welding; rather than using a metal shield 30, a tubular extension can be formed on the socket 11. A ceramic protective tube may also be used.

The portion of the conductive track 26 which extends over the face 28 of the ceramic tube is electrically connected to a terminal bolt 32. Terminal bolt 32 is formed with a connecting flange 33. The terminal bolt 32 has a connecting thread 34 at its outer end, extending beyond the terminal end of the metal housing or socket 11. It is spaced from and electrically insulated with respect to the socket 11 by two insulating bushings 35, 36 which, for example, may be of ceramic. The insulating bushings 35, 36 have longitudinal bores 37, 36'. The insulating bushing 36 is first pushed with its longitudinal bore 37 on the terminal bolt 32 until it engages the upper side of the contact flange 33. A spring ring 38 is then placed on the upper side surface of the bushing 35. The spring ring 38 is provided to compensate for different thermal expansion of the various elements and parts of the glow plug 10. The upper insulating bushing 36 is then pushed over the connecting bolt 32 by threading the bore 36' thereof over the bolt 32. The upper surface of the bushing 36 has an inclined edge 39, coaxial with the central bore. A metallic pressure ring 40 is placed on the inclined or chamfered edge 39 in order to maintain proper spacing between the ring 40 and the central connecting bolt 32. The upper end of the socket 11 is then rolled or peened over, as seen at 41, to press elements 36, 38, 35 together and against the connecting flange 33 of the bolt 32.

Glow plugs of the construction as described are particularly suitable for internal combustion (IC) engines without external ignition, that is, IC engines of the Diesel type.

The second conductive track 27 is shown connected electrically to the socket 11. Rather than making the electrical connection as shown, a second internal connecting lead can be connected to the track 27 by interposing a suitable insulating layer or bushing between the ring 19 and the socket 11, or forming the ring 19 of insulating material. A second electrical connection, then carried out through suitable bores or grooves formed in the connecting flange 33 and bushings 35, 36, can be provided and constructed as well known in various glow plug arrangements.

Figure 3:
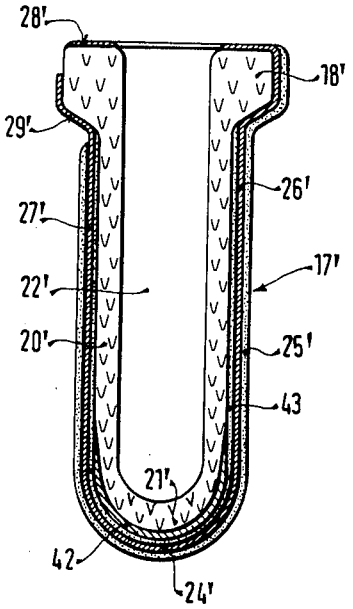
FIG. 3 is a schematic longitudinal sectional view through another embodiment of a ceramic carrier tube—heater element combination illustrating a particularly desirable form of the combination, to an enlarged scale.
Figure 4:
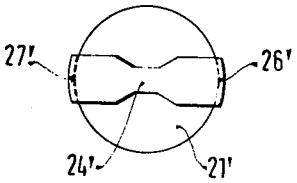
FIG. 4 is an end view of the outside of the tube of FIG. 3, showing the heater element, with protective coatings removed.

Embodiment of FIGS. 3 and 4: The glow plug heater 24'—FIG. 4—is a particularly desirable construction when fast preheating is important. The glow plug body 17' has a ceramic tube 20' with a flange 18' and a bottom 21', for incorporation into a socket, for example as illustrated in FIG. 1; this portion of the structure is basically similar to that shown in FIGS. 1 and 2. The outer surface of the bottom 21' of ceramic tube 20' has a heat conductive layer 42 applied thereto in accordance with any known method, and made, for example, of a platinum/aluminum oxide layer. The purpose of the heat conductive layer is to prevent excessive temperature gradients in the densely sintered ceramic tube 20'. This is accomplished by distributing heat which, in accordance with the particular heater construction, is concentrated essentially at only a single point. The heater element 24' is so constructed that heat is generated over only a very small area thereof. The heat conductive layer distributes the heat from this point-source over a wider area of the bottom 21'. The heat conductive layer 42 may be made of various metal/ceramic compounds, but preferably contains a metal which is platinum, a platinum metal, or alloys of platinum metal.

The heat conductive layer 42, in an example in which the tube 20' has the approximate dimensions of tube 20, FIGS. 1 and 2, may have a thickness of about 0.03 mm. It is covered by an intermediate layer 43, preferably made of porous ceramic, for example aluminum oxide, and having a thickness of about 0.02 mm. The intermediate porous aluminum oxide layer assists in preventing excessively rapid heat transfer from the heater element 24' to the ceramic tube 20'. The intermediate layer 43 also accepts differential expansion due to heat. Preferably, it extends up to the flange 18' of the ceramic tube 20'. The heat conductive layer 42 is extended over a greater area than that projected by the heater element 24' and is entirely covered by the electrically insulating intermediate layer 43.

A first conductive track 26' is located on the intermediate layer 43, which extends over the end face 28' of the ceramic tube 20'. As in the embodiment of FIGS. 1 and 2, the conductive tracks 26', 27' are made of a platinum metal-ceramic film or layer, extending down to the bottom 21' of the ceramic tube. The second conductive track 27' extends to the side 29' of the flange 18' facing the combustion chamber. It is preferably made of the same material as the conductive track 26'.

In accordance with a feature of the invention, the heater element 24' is formed as a constriction between the two conductive tracks 26', 27'. The heater element 24' then may have a length of only about 1 mm, and 0.5 mm width. Depending on the type of glow plug desired, and the heating characteristics, the length of the heater element 24' may extend to about 6 mm; it may, however, also be reduced in size to be essentially only point or dot-shaped, that is, a constriction formed between the conductive tracks in which the converging sides merge into each other without an intermediate straight portion, as shown for example in FIG. 4. The widths of the tracks 26', 27', as before, may be in the order of about 2 mm.

The region of the heater element 24' and of the conductive tracks 26', 27' is covered by a protective coating 25' which corresponds in arrangement, material, and function to that of the protective layer 25 on the glow plug body 17, FIG. 1.

The glow plug bodies 17, 17', that is, the various layer or film-like structural components 24, 25, 26, 27; 42, 43, 26', 27', 24', 25' and the respective ceramic tube 20, 20'; all can be sintered together in a single firing step. The heater electrodes 24, 24' and the associated conductive tracks 26, 27 or 26', 27', respectively, need not necessarily be applied to the outer side surface of the ceramic tube 20, 20'; they could be applied to the surface facing the hollow interior space 22, 22' of the ceramic tube 20, 20'. It is also possible, of course, to apply heater elements 24, 24' on the outside as well as on the inside surfaces of the ceramic tubes 20, 20'.

Glow plugs constructed with a glow body 17' in accordance with FIGS. 3 and 4 can reach the temperature necessary to ignite fuel vapor-air mixture in less than 1 second. The requisite temperatures can be reached with glow plug bodies 17' even if the applied voltage has dropped from a nominal voltage level of 12 V to a level in the order of about 9 V in 1.5 seconds, or less; the power consumption is only half that as in known glow plugs utilizing a thin-walled metallic glow plug housing within which a resistance wire is placed, embedded in a ceramic material.

In accordance with a feature of the invention, the glow plug bodies 17, 17' can easily be combined with an opto-electrical combustion sensor 44. Such a combustion sensor 44 is a light guide made of a quartz glass rod, or a light guide fiber bundle, positioned in a longitudinal bore 45 of the connecting bolt 32. The combustion sensor 44 extends from the end portion of the bolt 32—see FIG. 1—somewhat into the interior space 22 of the ceramic tube. Preferably, the projecting portion 44 is clear from any contact with the ceramic tube or surrounding elements in order to prevent heat conduction thereby. The thin-walled ceramic tube 20 protects the sensor 44 with respect to contamination, for example blackening due to deposition of soot, carbon particles and the like. The ceramic tube 20, being very thin, is sufficiently transparent to permit good penetration of light resulting upon combustion. The portion of the combustion sensor 44 extending outside from the bolt 32 beyond the threaded end 34 is usually jacketed with opaque material, and can be connected to any well known opto-electrical transducer. Opto-electronic sensors, and especially in combination with internal combustion engines, are known and described, for example, in U.S. patent applications Ser. No. 214,481, filed Dec. 9, 1980, MULLER et al Ser. No. 214,720, filed Dec. 9, 1980, LINDER et al Ser. No. 214,513, filed Dec. 9, 1980, MAURER et al and corresponding to German Disclosure Document DE-OS No. 30 11 570; other opto-electric sensors are described in U.S. Ser. No. 104,936, filed Dec. 18, 1979, refiled as Continuation application Ser. No. 344,104, filed Jan. 29, 1982, KOMAROFF et al., corresponding to German Disclosure Document DE-OS No. 29 05 506; U.S. application Ser. No. 314,651, filed Oct. 26, 1981, MULLER, corresponding to DE-OS No. 30 42 399; and U.S. Ser. No. 314,529, filed Oct. 26, 1981, BURKEL, corresponding to DE-OS No. 30 42 452, all assigned to the assignee of the present application.

When using the glow plug in combination with an optical sensor 44, it is desirable to form the shield tube 30 with a viewing opening 31*a* at the facing end surface thereof in order to permit good light transmission from the combustion event within a combustion chamber into which the glow plug is screwed. If no light sensing features are required, it is sufficient if the openings 31 are located in any place suitable for ease of manufacturing of the shield tube 30.

Various changes and modifications may be made, and features described in connection with one of the embodiments may be used with the other, within the scope of the inventive concept.

The electrodes 26, 27; 26', 27', as well as the heater element 24, 24', when formed as a mixture of a platinum metal, platinum-metal alloy, for example platinum-rhodium alloy, mixed with aluminum oxide, should have a sufficient metallic content to provide sufficient conductivity for a heater current which delivers the requisite heat energy at the heater element. In the example given, a suitable heater current, for a nominal battery voltage of 12 V is initially in the order of about 8 ampere and decreases to about 2 ampere within about 5 seconds caused by the PTC-characteristic of the material used.

A suitable material for the heater elements 24, 24' consists of 79% (by weight) platinum, 9% (by weight) rhodium and 12% (by weight) aluminum oxide.

A suitable thickness for the tracks 26, 27, 26', 27', and for the heater portion 24, 24', is: 0.05 mm.

The dimensions and ranges set forth in the specification and in the claims are deemed to include variations within ordinary commercial and industrial design and manufacturing tolerances.

We claim:

1. Glow plug for preheating of gases, particularly for use in an internal combustion engine, having a tubular metal holding plug (11) having an opening (12) therethrough;

a ceramic tube (20, 20') secured with one end in the opening of the plug;

an electric heater means (24, 24') located on the surface of said ceramic tube;

and at least one connecting element (32) extending through the central opening of the plug and insulated therefrom;

wherein the ceramic tube has a closed bottom (21) at the other end thereof defining an enclosed hollow interior space (22) within the tube;

electrical heater current connection means (26, 27; 26', 27' are provided, extending from the region of the holding plug to the heater means (24, 24') and electrically connected thereto, and including an electrical connection to said connecting element (32);

and wherein said heater means (24, 24') is a layer or film of metal located on the tube essentially only in the region of said closed bottom (21).

2. Plug according to claim 1, wherein the maximum cross-sectional thickness of closed bottom (21, 21') of the ceramic tube is 1.0 mm.

3. Plug according to claim 1, wherein the cross-sectional thickness of the closed bottom (21, 21') is between 0.3 and 0.6 mm.

4. Plug according to claim 1, wherein the diameter of said ceramic tube is between 5 and 6 mm.

5. Plug according to claim 1, wherein the connection means conductive tracks (26, 27; 26', 27') applied longitudinally on the ceramic tube (20, 20') and connected to said layer or film heater means (24, 24'), at least one of said conductive tracks being electrically connected to said at least one connecting element (32).

6. Plug according to claim 5 further including an electrically insulating protective layer (25, 25') applied over said conductive tracks and said heater means.

7. Plug according to claim 1, further including an electrically insulating porous intermediate layer (23, 43) between the layer or film heating means (24') and the closed bottom (21') of the ceramic tube (20').

8. Plug according to claim 7, wherein the porous electrically insulating intermediate layer (23, 43) is applied over an area of said bottom which is greater than the area covered by said layer or film heater means.

9. Plug according to claim 1, further including a heat conductive layer (42) positioned between an intermediate porous electrically insulating layer (43) and the closed bottom (21') of the ceramic tube (20'), said heat conductive layer (42) covering an area over said closed bottom which is greater than the coverage area of said layer or film heater means (24') to distribute concentrated heat from said heater means over an extended area of the closed bottom of the ceramic tube.

10. Plug according to claim 1, wherein (FIG. 1) the layer or film heater means is of undulating or zig-zag configuration.

11. Plug according to claim 1, wherein the layer or film heater means is of strip-like configuration with an intermediate constriction or pinch zone.

12. Plug according to claim 1, wherein said connection means include (FIGS. 3, 4) electrically conductive connecting tracks (26', 27') extending longitudinally along said ceramic tube (20'), said layer or film heater means (24') being formed as a constriction or pinch zone in a connecting continuation of said connecting strips (26', 27').

13. Plug according to claim 11 or 12, wherein said constriction or pinch zone forming the layer or film heater means (24') has a maximum length of 6 mm.

14. Plug according to claim 1, wherein the layer or film heater means (24, 24') is located on at least one of the surfaces of said ceramic tube.

15. Plug according to claim 14, wherein said layer or film heater means (24, 24') is located on the outer surface of the bottom (20, 20') of the ceramic tube.

16. Plug according to claim 1, further including a protective shield (30) surrounding, with clearance, the ceramic tube (20, 20'), said shield including at least one opening (31, 31*a*) to provide access of gas to be heated to the heater means on the ceramic tube.

17. Plug according to claim 1, wherein the hollow interior space is empty; further including an opto-electrical sensing means (44) in optical communication with the hollow interior space (22, 22') of said tube (20, 20').

18. Plug according to claim 17, wherein said at least one connecting means comprises a connecting bolt (32) centrally positioned within said holding plug (11), said bolt being formed with a longitudinal through-bore;

and said opto-electrical sensing means comprises a light guide element extending through the through-bore (45) of said connecting bolt (32).

19. Plug according to claim 18, further including a protective shield (30) surrounding, with clearance, the ceramic tube (20, 20'), said shield including at least one opening (31, 31*a*) to provide access of gas to be heated to the heater means on the ceramic tube;

and wherein said at least one opening (31*a*) is in axial alignment with said light guide (44) to provide for direct sensing of light caused by a combustion event in the internal combustion engine transmitted through said closed bottom of the tube (20, 20').

20. Plug according to claim 1, wherein said tube comprises aluminum oxide and has an outer diameter in the order of about 5 mm;

a tubular wall thickness in the order of about 0.5 mm, and said layer or film heater means comprises at least one of the materials selected from the group consisting of a platinum metal, an alloy of platinum metals, silver-Perowskite; mixed with aluminum oxide.

21. Plug according to claim 1, wherein the bottom (21) of the ceramic tube is essentially cup-shaped.

22. Plug according to claim 1, wherein the bottom (21, 21') of the ceramic tube (20, 20') is essentially semi-spherical and merges smoothly with the tube.

23. Plug according to claim 1, wherein said hollow interior space is empty.

* * * * *